US011547889B2

(12) United States Patent
Kjellman

(10) Patent No.: US 11,547,889 B2
(45) Date of Patent: Jan. 10, 2023

(54) FUSIBLE MECHANICAL LINKAGES FOR FIRE SUPPRESSION SYSTEMS

(71) Applicant: Carrier Corporation, Farmington, CT (US)

(72) Inventor: Thomas Kjellman, Uxbridge, MA (US)

(73) Assignee: Carrier Corporation, Palm Beach Gardens, FL (US)

( * ) Notice: Subject to any disclaimer, the term of this patent is extended or adjusted under 35 U.S.C. 154(b) by 423 days.

(21) Appl. No.: 16/757,803

(22) PCT Filed: Oct. 24, 2018

(86) PCT No.: PCT/US2018/057327

§ 371 (c)(1),
(2) Date: Apr. 21, 2020

(87) PCT Pub. No.: WO2019/084149

PCT Pub. Date: May 2, 2019

(65) Prior Publication Data

US 2021/0370115 A1 Dec. 2, 2021

Related U.S. Application Data

(60) Provisional application No. 62/578,170, filed on Oct. 27, 2017.

(51) Int. Cl.

| | |
|---|---|
| ***A62C 37/48*** | (2006.01) |
| ***A62C 37/42*** | (2006.01) |
| ***A62C 3/00*** | (2006.01) |

(52) U.S. Cl.

CPC ..... *A62C 37/48* (2013.01); *A62C 37/42* (2013.01); *A62C 3/006* (2013.01)

(58) Field of Classification Search

CPC ..... A62C 37/48; A62C 37/42; A62C 3/006; A62C 2/242; A62C 37/10; A62C 37/11;

(Continued)

(56) References Cited

U.S. PATENT DOCUMENTS 4,334,570 A * 6/1982 Adams ..... F24F 13/10 160/1
4,805,261 A * 2/1989 Barchechat ..... F16G 15/04 16/222

(Continued)

FOREIGN PATENT DOCUMENTS

JP S59 69462 U 5/1984

OTHER PUBLICATIONS

International Search Report issued in PCT/US2018/057327, dated Jan. 29, 2019.

*Primary Examiner* — Justin M Jonaitis
(74) *Attorney, Agent, or Firm* — Locke Lord LLP; Scott D. Wofsy; Joshua L. Jones

(57) ABSTRACT

A fusible mechanical linkage includes a tensioner having an aperture and a spool with guides arranged on an end of the spool opposite the aperture. The guides define a cable seat between one another. A fusible alloy is arranged between the spool and the tensioner, the fusible alloy fixing the spool to the tensioner below a predetermined temperature, the fusible alloy allowing tension carried by an actuation cable received in the cable seat to rotate the spool relative to the tensioner above the predetermined temperature. Fire suppression systems and methods adjusting actuation cables in fire suppression systems are described.

20 Claims, 8 Drawing Sheets

(58) Field of Classification Search
CPC . A62C 37/12; F16K 17/383; Y10T 137/1639; Y10T 137/1797
USPC ..... 169/57, 7, 42
See application file for complete search history.

(56) References Cited

U.S. PATENT DOCUMENTS

| | | | | |
|---|---|---|---|---|
| 5,273,119 | A | 12/1993 | Dick | |
| 5,871,056 | A * | 2/1999 | Renna | A62C 37/12 169/65 |
| 6,105,597 | A * | 8/2000 | Willetts | F16K 17/383 137/75 |
| 2005/0126797 | A1 * | 6/2005 | Mikulec | A62C 37/38 169/65 |

* cited by examiner

FUSIBLE MECHANICAL LINKAGES FOR FIRE SUPPRESSION SYSTEMS

CROSS-REFERENCE TO RELATED APPLICATIONS

This application is a U.S. National Phase Application filed under 35 U.S.C. § 371, based on International Patent Application No. PCT/US2018/057327, filed Oct. 24, 2018, which claims priority to U.S. Patent Provisional Application No. 62/578,170, filed on Oct. 27, 2017. The entire contents of these applications are incorporated herein by reference.

BACKGROUND OF THE INVENTION

1. Field of the Invention

The present disclosure relates to fusible mechanical linkages, and more particularly to fusible mechanical linkages for controlling tension in fire suppression system activation cables.

2. Description of Related Art

Fire suppression systems, such as in commercial kitchens, commonly include a suppressant reservoir housing fire suppressant. A valve retains the suppressant in the reservoir until fire is detected, at which point the valve is actuated to allow suppressant to issue from the reservoir and into the area protected by the fire suppression system. Actuation is typically by operation of a fusible link and cable, which operably connects the fusible link to the valve.

Fusible links are mechanical devices that generally consist of two pieces of metal connected to one another by a fusible alloy. Below a specific temperature the fusible alloy fixes the two pieces of metal to one another. When exposed to temperatures above the specific temperature the fusible alloy softens, allowing the two pieces of metal to separate from one another with relatively little force. In fire suppression systems fusible links generally communicate cable tension until the specific temperature is reached—at which point the tension present in the cable breaks the fusible link and unloads to actuate the valve. Fusible links are commonly employed in cooperation with cable take-up devices, which remove slack and load the cable in tension.

Such conventional methods and systems have generally been considered satisfactory for their intended purpose. However, installing and adjusting fusible mechanical linkages and fire suppression systems, and servicing such linkages and systems, may be complicated and time-consuming due to the complication of the systems.

SUMMARY OF THE INVENTION

A fusible mechanical linkage includes a tensioner having an aperture and a spool arranged on an end of the spool opposite the aperture. Guides of the spool define a cable seat between one another. A fusible alloy is arranged between the spool and the tensioner, the fusible alloy fixing the spool to the tensioner below a predetermined temperature, the fusible alloy allowing tension carried by an actuation cable received in the cable seat to rotate the spool relative to the tensioner above the predetermined temperature.

In certain embodiments the fusible alloy can include metallic material having a melting point that is about the same as temperature in a fire fueled cooking oil or grease. The fusible alloy can include a solder or braze material. The tensioner can have a cleat arranged. The cleat can be arranged for palming in a one-handed twisting motion for applying tension to an actuation cable extending through the cable seat.

In accordance with certain embodiments, the tensioner can have a catch. The catch can be connected to the tensioner. The catch can be longitudinally offset from the aperture. The catch can have a notch. The catch can have a ramp. The ramp can be arranged on a side of the catch opposite the notch. The catch can have a column body. The column body can be connected on an end to the tensioner. It is contemplated that the catch can have a fin. The fin can be connected at an edge to the tensioner.

It is also contemplated that, in accordance with certain embodiments, the catch can be a first catch and the fusible mechanical linkage can additionally include a second catch. The second catch can be connected to the tensioner on a side of the spool longitudinally opposite the first catch. The spool can include a column, connected to the tensioner by the fusible alloy, the spool guides being defined by knob portions connected to the tensioner by the column. The actuation cable can extend between the knob portions and wrap about exterior surface portions of the column. The spool can include a plate member, fixed to the tensioner by the fusible alloy, the guides being defined by cleats connected to the tensioner by the plate member. The cable can extend through the cable seat, between the cleats, and wrap about the exterior surface portions of the cleats.

A fire suppression system includes a fusible mechanical linkage as described above having notched first and second catches. The first catch is longitudinally offset from the aperture and the second catch is arranged on the tensioner on a side of the aperture opposite the first catch. A cable extends through the first and second catches and the cable seat, and is operably connected to a valve for issuing suppressant into a protected space upon activation.

A method of adjusting a fire suppression system actuation cable includes seating an actuation cable in a fusible mechanical linkage as described above and rotating the fusible mechanical linkage about the cable, the cable wrapping thereby about spool to load the actuation cable in tension. In certain embodiments the method can include seating the actuation cable in first and second catches. In accordance with certain embodiments, the method can include heating the fusible alloy and rotating the spool relative to the tensioner, the cable unwrapping from the spool to release tension from the actuation cable. It is contemplated the fusible mechanical linkage can be rotated to release the actuation cable tension, an element of the fire suppression system serviced, and the fusible mechanical linkage rotated about the cable to wrap the cable about spool to again load the actuation cable in tension.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

The present disclosure provide for fusible mechanical linkages, fire suppression systems, and methods of adjusting fire suppression system actuation cables with superior properties including simplified installation and adjustment.

Figure 1:
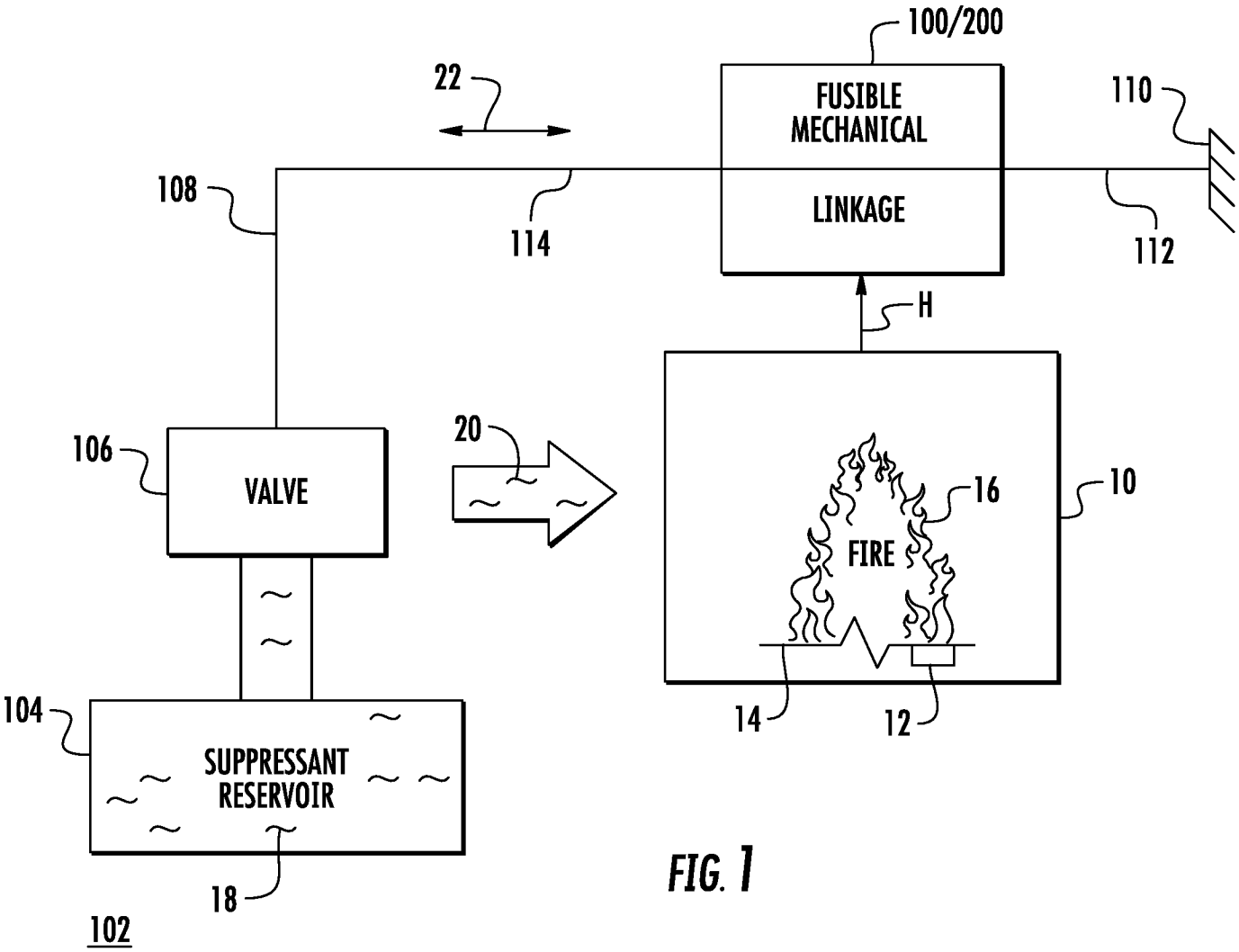
FIG. 1 is a diagrammatic view of an exemplary embodiment of a fire suppression system constructed in accordance with the present disclosure, showing a fusible mechanical linkage coupled to an actuation cable for loading the actuation cable with a tensile load.

Reference will now be made to the drawings wherein like reference numerals identify similar structural features or aspects of the subject disclosure. For purposes of explanation and illustration, and not limitation, a partial view of an exemplary embodiment of fusible mechanical linkage in accordance with the disclosure is shown in FIG. 1 and is designated generally by reference character 100. Other embodiments of fusible mechanical linkages, fire suppression systems, and methods of adjusting actuator cable tension in fire suppression systems in accordance with the disclosure, or aspects thereof, are provided in FIGS. 2-8, as will be described. The systems and methods described herein can be used installing and servicing fire suppression systems, such as in fire suppression systems protecting stoves and exhaust hoods in commercial kitchens, though the present disclosure is not limited to commercial kitchens or to fire suppression systems in general.

Referring to FIG. 1, a fire suppression system 102 is shown. Fire suppression system 102 includes a suppressant reservoir 104, a valve 106, and an actuation cable 108. Suppressant reservoir 104 retains a suppressant 18 suitable for suppression of fire 16 within a protected space 10. Protected space 10 has a fuel supply 12 and an ignition source 14. Protected space 10 can be, for example, a cooking area within a commercial kitchen or an exhaust hood for a commercial kitchen. Fuel supply 12 can be grease or cooking oil and ignition source 14 can be a fryer or stove. As will be appreciated by those of skill in the art, proximity of fuel supply 12 and ignition source 14 can result in fire 16. Fire suppression system 102 is arranged to suppress fire 16 in the event that ignition source 14 ignites fuel supply 12.

Valve 106 is arranged to selectively place suppressant reservoir 104 in fluid communication with protected space 10. In this respect valve 106 is in fluid communication with suppressant reservoir 104 and has closed and open states. When in the closed state valve 106 fluidly isolates suppressant reservoir 104 from protected space 10. When in the open state valve 106 places suppressant reservoir 104 in fluid communication with protected space 10. Fluid communication between suppressant reservoir 104 and protected space 10 enables suppressant 18 to issue 20 in to protected space 10, suppressing fire 16.

Actuation cable 108 and fusible mechanical linkage 100 are arranged to operate valve 106. In this respect actuation cable 108 is operatively connected to valve 106 and extends to a fixation location 110, which is fixed relative to valve 106. Fusible mechanical linkage 100 is coupled to actuation cable 108 at a location along the length of actuation cable 108, e.g., between first segment 112 and a second segment 114 of a continuous (uninterrupted) length of actuation cable 108, and is arranged to load actuation cable 108 with a tensile load 22. When tensile load 22 is greater than a predetermined load value the valve 106 remains in the closed state. When tensile load 22 drops below the predetermined load value the valve 106 opens, assuming the open state and allowing suppressant 18 to flow into protected space 10 via issue 20. It is contemplated that actuation cable 108 pass through fusible mechanical linkage 100 within interruption, that is that there be no breaks or splices between first segment 112 of actuation cable 108, located between fusible mechanical linkage 100 and fixation location 110, and a second segment 114 of actuation cable 108, located between fusible mechanical linkage 100 and valve 106.

Figure 2:
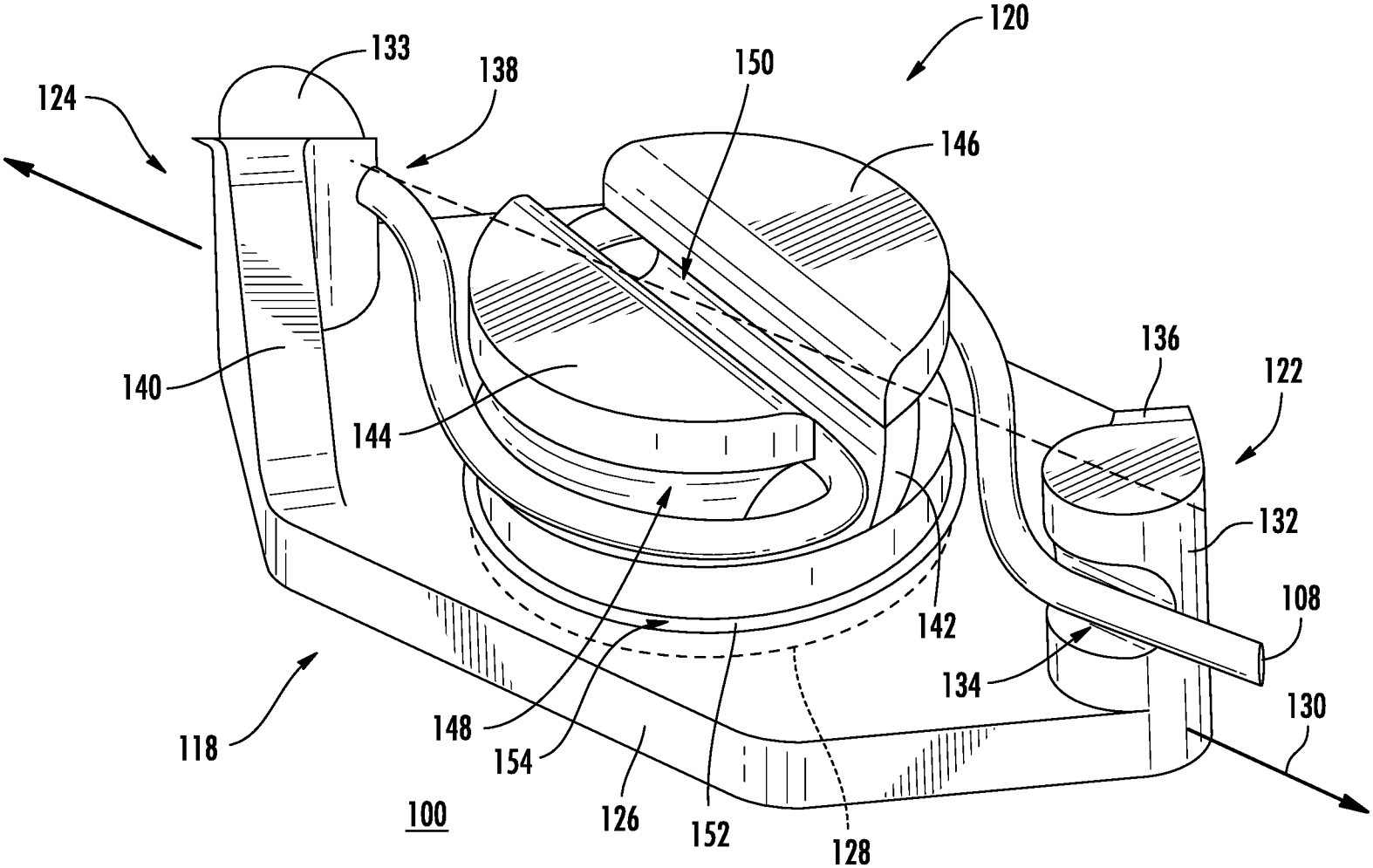
FIG. 2 is a perspective view of the fusible mechanical linkage of FIG. 1 according to a first embodiment, showing a spool with a column and catches retaining the actuation cable.

Referring to FIG. 2, fusible mechanical linkage 100 is shown. Fusible mechanical linkage 100 includes a tensioner 118, a spool 120, a first catch 122, and second catch 124. Tensioner 118 has a plate body 126 with an aperture 128 and defines a longitudinal axis 130. Aperture 128 is arranged along longitudinal axis 130 in an approximating central location. Spool 120 is fixed within aperture 128 and is longitudinally arranged between first catch 122 and second catch 124. First catch 122 is connected to tensioner 118 and is arranged along longitudinal axis 130. Second catch 124 is connected to tensioner 118 and is arranged along longitudinal axis 130 on a side of spool 120 opposite first catch 122.

First catch 122 includes a column 132 with a notch 134 and a ramp 136. Notch 134 is arranged on a side of column 132 opposite ramp 136. Ramp 136 is angled obliquely relative to longitudinal axis 130 and extends between a surface of plate body 126 and an end of column 132 opposite the surface of plate body 126. Second catch 124 is similar to the first catch 122 and additionally includes a column 133 with a notch 138. Notch 138 is arranged on a side of longitudinal axis 130 opposite notch 134 of first catch 122. Second catch 124 also has a ramp 140, which arranged on a side of second catch 124 opposite ramp 136 of first catch 122.

Spool 120 includes a column body 142 with a first knob portion 144 and a second knob portion 146. First knob portion 144 and second knob portion 146 are connected to column body 142 at a column body end 148, e.g., an axial end of column body 142, opposite tensioner 118. First knob portion 144 and second knob portion 146 define between one another a cable seat 150. Cable seat 150 is arranged to slidably receive actuation cable 108 and is angled relative to longitudinal axis 130. In the illustrated exemplary embodiment cable seat 150 is angled obliquely relative to longitudinal axis 130 for winding actuation cable 108 about column body 142 as fusible mechanical linkage 100 is twisted about actuation cable 108, i.e., rotated about an axis extending through column body 142.

An engagement 152 fixes spool 120 to tensioner 118. Engagement 152 can include, for example, a peg/aperture interface, a male/female thread interface, a ratcheted interface, between plate body 126 and spool 120. In the illustrated exemplary embodiments described herein interface 152 includes a fusible alloy 154 that fixes spool 120 in rotation relative to tensioner 118. This is for illustration purposes only. As will be appreciated by those of skill in the art in view of the present disclosure linkages having engagements without fusible materials can also benefit from the present disclosure.

Figure 4A:
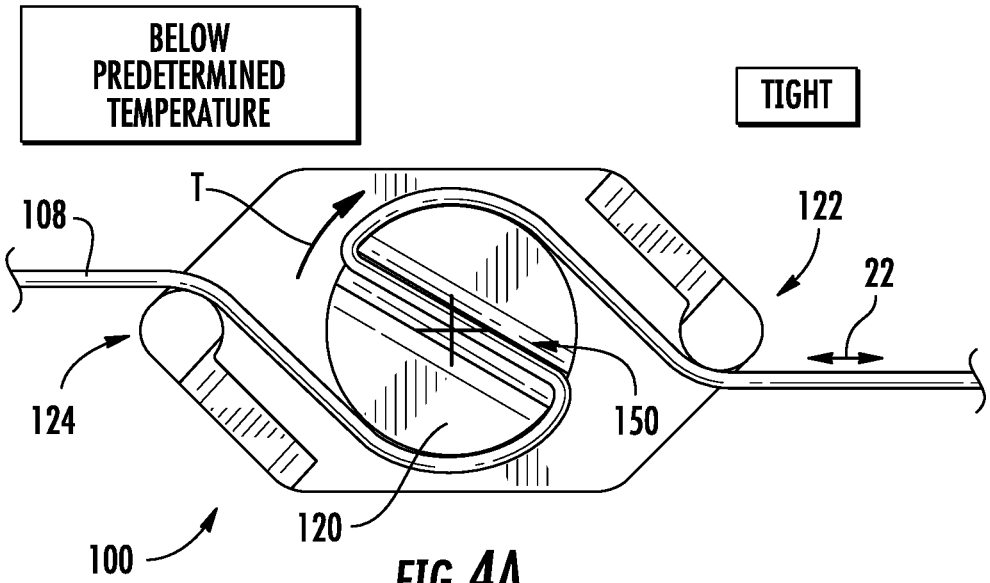
FIGS. 4A and 4B are plan views of the fusible mechanical linkage of FIG. 2, showing the spool of the fusible mechanical linkage in tight and released positions.
Figure 4B:
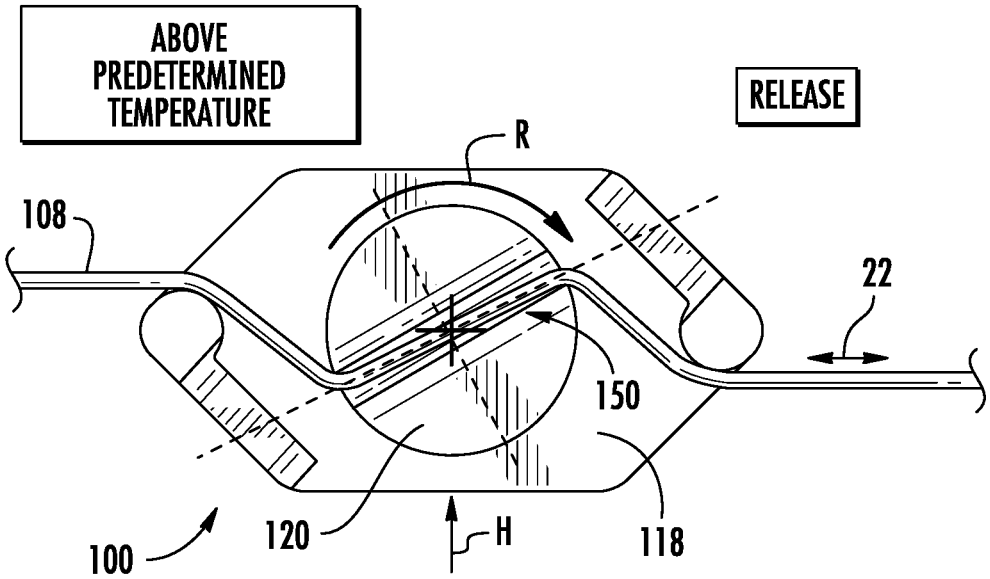

It is contemplated that fusible alloy 154 have a melting point such that, upon application of heat H (shown in FIG. 1) communicated by fire 16 to fusible mechanical linkage 100, fusible alloy 154 softens such that spool 120 becomes rotatable relative to tensioner 118, tensile load 22 (shown in FIG. 1) thereby rotating spool 120 relative to tensioner 118, as shown in FIG. 4B. Rotation of spool 120 in turn unloads actuation cable 108, causing valve 106 (shown in FIG. 1) to open, suppressant 18 (shown in FIG. 1) thereby issuing into protected space 10 (shown in FIG. 1). It is contemplated that fusible alloy 154 include a material like solder or braze, each of which have melting points approximating that of a grease or cooking oil fire, tuning the responsiveness of fusible mechanical linkage 100 to the hazards which fire suppression system 102 (shown in FIG. 1) is arranged to mitigate.

Figure 3A:
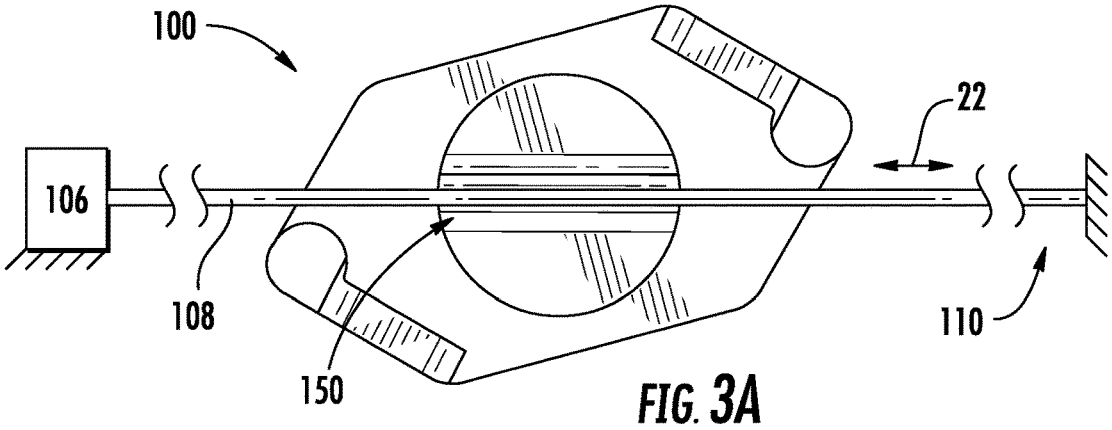
FIGS. 3A-3C are plan views of the fusible mechanical linkage of FIG. 2, showing fusible mechanical linkage tightening and holding the actuation cable to retain tensile load in the cable.
Figure 3B:
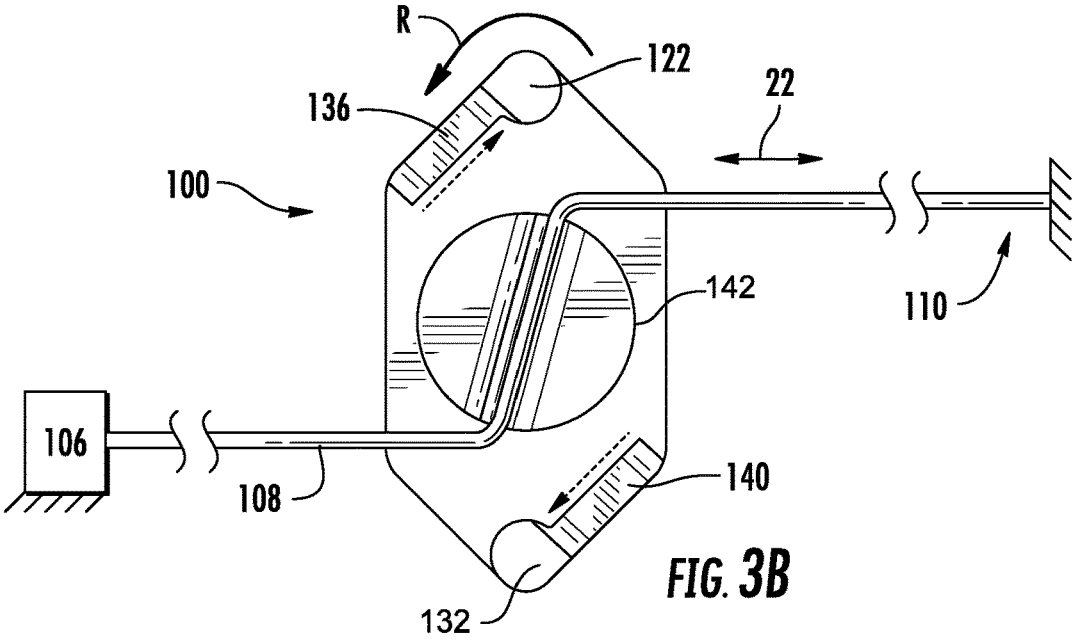
Figure 3C:
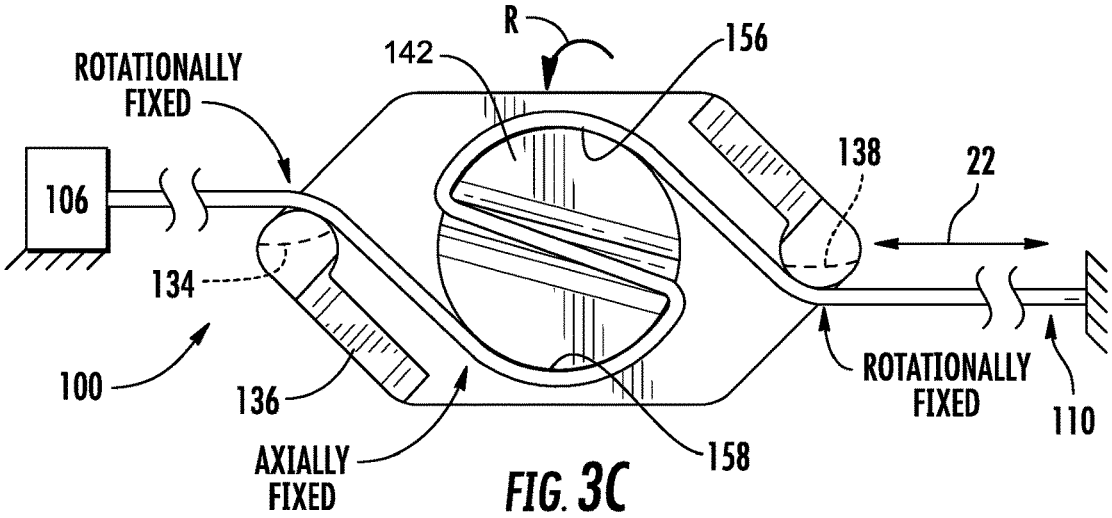

Referring to FIGS. 3A-3C, fusible mechanical linkage 100 is shown being coupled to actuation cable 108. As shown in FIG. 3A, fusible mechanical linkage 100 is seated on actuation cable 108 such that actuation cable 108 is received with cable seat 150. Tensile load 22 is relatively small in the arrangement shown in FIG. 3A, as indicated by the length of the double-headed arrow symbolically representing tensile load 22 in FIG. 3A relative to the lengths of the double-headed arrows schematically illustrating tensile load 22 in FIGS. 3B and 3C.

Once seated on actuation cable 108, fusible mechanical linkage 100 is rotated relative to actuation cable 108 in a rotary motion R. The rotary motion R of fusible mechanical linkage 100 causes actuation cable 108 to wrap about the outer periphery of column body 142, shortening the length of actuation cable 108. Because the ends of actuation cable 108 are fixed, e.g., at fixation location 110 and valve 106, respectively, shortening the length of actuation cable 108 increases tensile load 22 carried by actuation cable 108. It is contemplated that rotation R continue until tensile load 22 accumulates in actuation cable 108 to an amount that exceeds the predetermined tensile load necessary to retain valve 106 in a closed arrangement.

During rotation of fusible mechanical linkage 100 actuation cable 108 comes into sliding engagement with the ramps of the catches, i.e., ramp 136 of first catch 122 and ramp 140 of second catch 124. The sliding engagement, illustrated with dashed arrows in FIG. 3B adjacent to ramp 136 and ramp 140, causes further rotation of fusible mechanical linkage 100 to displace actuation cable away, i.e., out of the drawing sheet showing FIG. 3B, relative to tensioner 118. Displacement of actuation cable 108 relative to tensioner 118 enables actuation cable to slide over the top each catch, i.e., first catch 122 and second catch 124, thereby traversing the catches. Tensile load 22 causes actuation cable 108 to snap into and become captive within the notches, i.e. notch 134 of first catch 122 and notch 138 of second catch 124, as shown in FIG. 3C. Once actuation cable 108 becomes captive in the respective notches of fusible mechanical linkage 100 becomes fixed to actuation cable 108 and retains tensile load 22 within actuation cable 108.

It is contemplated that fusible mechanical linkage 100 can be arranged for one-handed operation. For example, tensioner 118 can be sized to fit within the palm of a user. Tensioner 118 can be dimensioned with major and minor axes for palming and twisting by a user. As will be appreciated by those of skill in the art, magnitude of tensile load 22 corresponds to respective lengths of portions of actuation cable 108 which wrap about an exterior surface portion 156 and an exterior surface portion 158 of column 132. In the illustrated exemplary embodiment tensioner 118 has a hexagonal shape arranged for palming and twisting by a single hand of a user for simplified tensioning of and fixation to actuation cable 108. This is for illustration purposes only and is non-limiting as other shapes can also be utilized to allow for single-handed use, as suitable for an intended application.

With reference to FIGS. 4A and 4B, fusible mechanical linkage 100 is shown when tight and when released. As shown in FIG. 4A, when tight, actuation cable 108 extends through first catch 122, wraps about the exterior periphery of spool 120 and through cable seat 150, and extends through first catch 122 and second catch 124. Tensile load 22, carried by actuation cable 108, exerts a torque T on spool 120, which is opposed by fixation of spool 120 to tensioner 118 by engagement 152 and fusible alloy 154 (shown in FIG. 2). First catch 122 and second catch 124 exert oppositely directed forces on actuation cable 108 with lateral components (relative to longitudinal axis 130) of equal magnitude. This arrangement causes actuation cable 108 to remain captive upon fusible mechanical linkage 100, fusible mechanical linkage 100 retaining tensile load 22 within actuation cable 108, and tensile load 22 in turn causing valve 106 (shown in FIG. 1) to remain in the closed state.

Upon absorption of a predetermined amount of heat H, fusible alloy 154 (shown in FIG. 2) softens. Softening of fusible alloy 154 releases engagement 152, and thereby spool 120 from tensioner 118, allowing torque T exerted on spool 120 by actuation cable 108 to rotate spool 120 relative to tensioner 118 in a rotary motion R. Rotary motion R of spool 120 relative to tensioner 118 releases some (or all) of tensile load 22 from actuation cable 108 via the exemplary clockwise-directed rotation of spool 120 between the tight state, shown in FIG. 4A, and the released state, shown in FIG. 4B, as indicated by the relative position of cable seat 150 in each FIGS. 4A and 4B. Release of tensile load 22 in turn causes valve 106 (shown in FIG. 1) to assume the open state, suppressant 18 (shown in FIG. 1) thereby issuing into protected space 10 (shown in FIG. 1).

Figure 5:
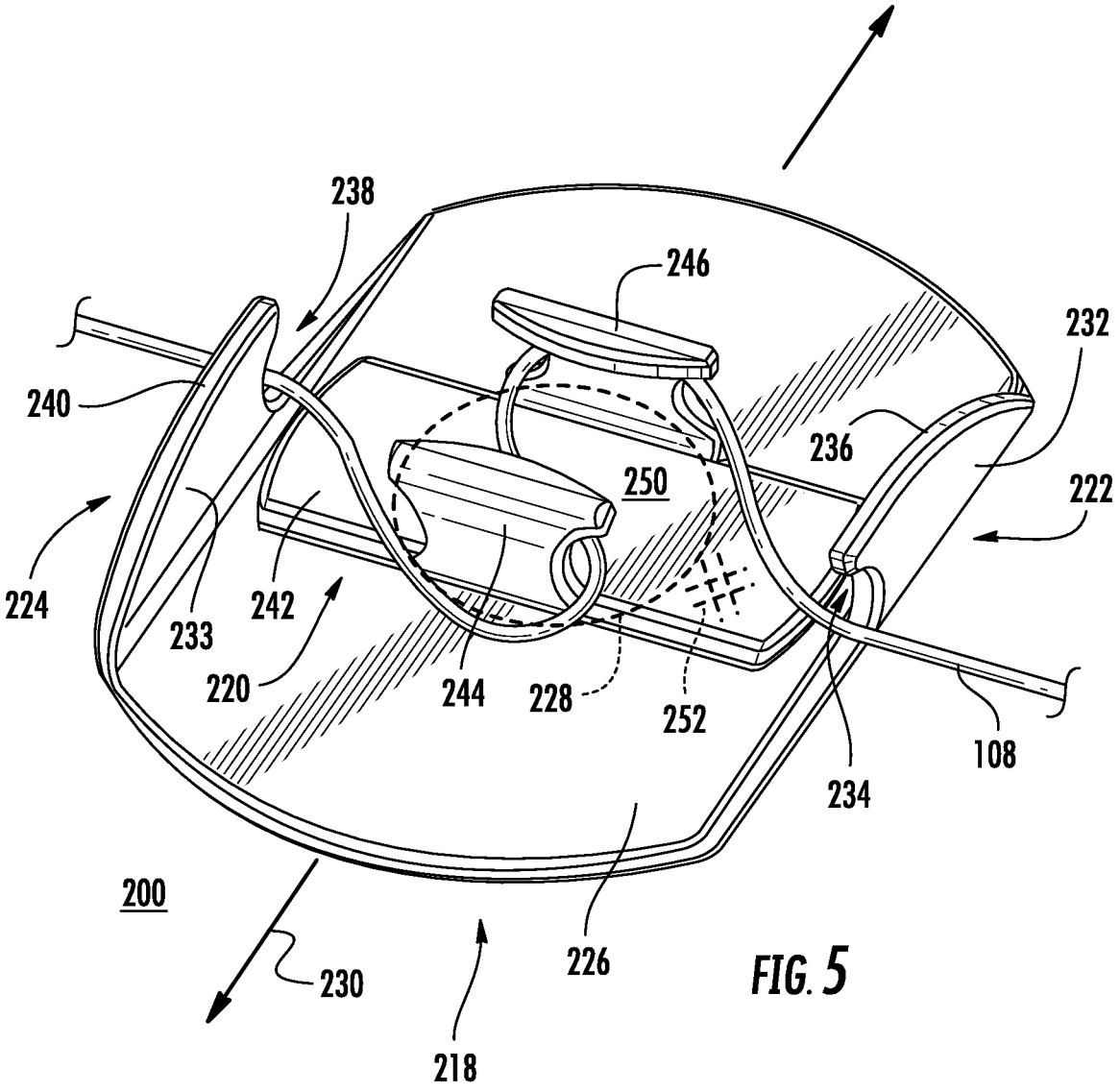
FIG. 5 is a perspective view of the fusible mechanical linkage of FIG. 1 according to a second embodiment, showing a spool with cleats and fins retaining the actuation cable.

With reference to FIG. 5, a fusible mechanical linkage 200 according to another exemplary embodiment is shown. Fusible mechanical linkage 200 is similar to fusible mechanical linkage 100 (shown in FIG. 1), and additionally includes a tensioner 218 defining a longitudinal axis 230, a spool 220, a first catch 222, and a second catch 224. First catch 222 and second catch 224 are located at laterally opposite sides of tensioner 218. Tensioner 218 has a sheet body 226 with an aperture 228 extending therethrough, sheet body 226 stiffened by the arrangement of first catch 222 and second catch 224 located on laterally opposite sides of sheet body 226. As will be appreciated by those of skill in the art in view of the present disclosure, stiffening sheet body 226 can reduce the weight and cost of fabricating fusible mechanical linkage 200.

Spool 220 is fixed within aperture 228 and is laterally arranged between first catch 222 and second catch 224. First catch 222 is defined by a portion of sheet body 226 orthogonal relative to sheet body 226 and is arranged on a lateral side of longitudinal axis 230 opposite first catch 222. Second catch 224 is defined by a portion of sheet body 226 also orthogonal relative to sheet body 226 and is arranged on a lateral side of longitudinal axis 230 opposite first catch 222.

First catch 222 includes a fin 232 with a notch 234 and a ramp 236. Notch 234 is arranged on a side of fin 232 opposite ramp 236. Ramp 236 is substantially parallel to longitudinal axis 230 and extends from a longitudinal edge of sheet body 226, along a lateral edge of sheet body 226. Second catch 224 is similar to first catch 222 and additionally includes a fin 233 with a notch 238 and a ramp 240. Notch 238 is arranged on a side of longitudinal axis 230 laterally opposite notch 234 of first catch 222. Ramp 240 is arranged on a side of second catch 224 opposite ramp 236 of first catch 222.

Spool 220 includes a plate member 242 with a first cleat 244 and a second cleat 246. First cleat 244 and second cleat 246 are connected to plate member 242 at laterally opposite sides of plate member 242 and define between one another a cable seat 250. Cable seat 250 is arranged to receive actuation cable 108, and in the locked state is substantially orthogonal relative to longitudinal axis 230. An engagement 252, containing a fusible alloy material 254 similar to fusible alloy 154 (shown in FIG. 2), fixes spool 220 to tensioner 218.

Figure 6A:
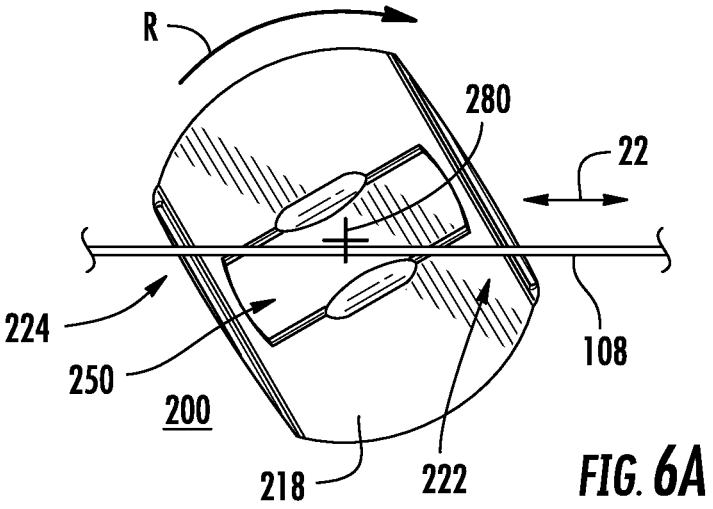
FIGS. 6A-6C are plan views of the fusible mechanical linkage of FIG. 5, showing fusible mechanical linkage tightening and holding the actuation cable to retain tensile load within the actuation cable.
Figure 6B:
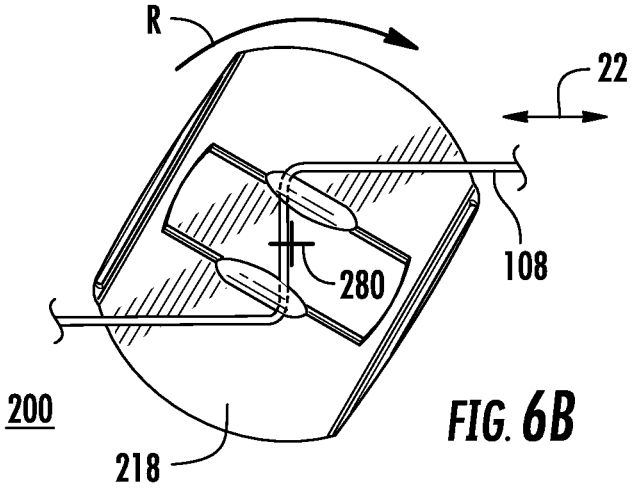
Figure 6C:
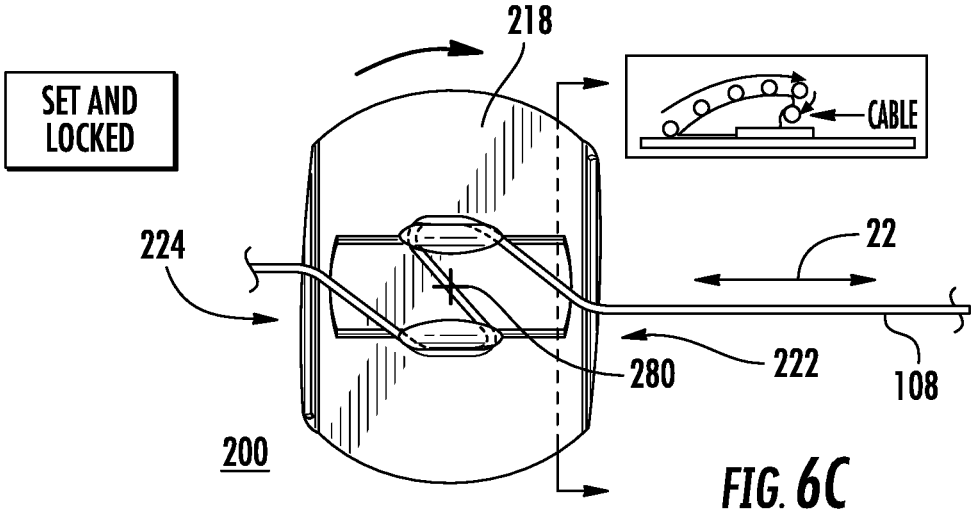

As shown in FIGS. 6A-6C, fusible mechanical linkage 200 receives actuation cable 108 within cable seat 250 and loads actuation cable 108 within progressively greater tensile load 22 as fusible mechanical linkage 200 rotates relative to actuation cable 108, i.e., about an axis 280 extending through the center of tensioner 218. As shown in FIG. 6C, as actuation cable 108 displaces relative to the surface of tensioner 218 during rotation, actuation cable 108 traversing ramps of first catch 222 and second catch 224 and seating in notch 234 (located on a side of first catch 222) and notch 238 (located on a side of second catch 224), thereby locking to actuation cable 108 to retain tensile load 22 in actuation cable 108.

Figure 7A:
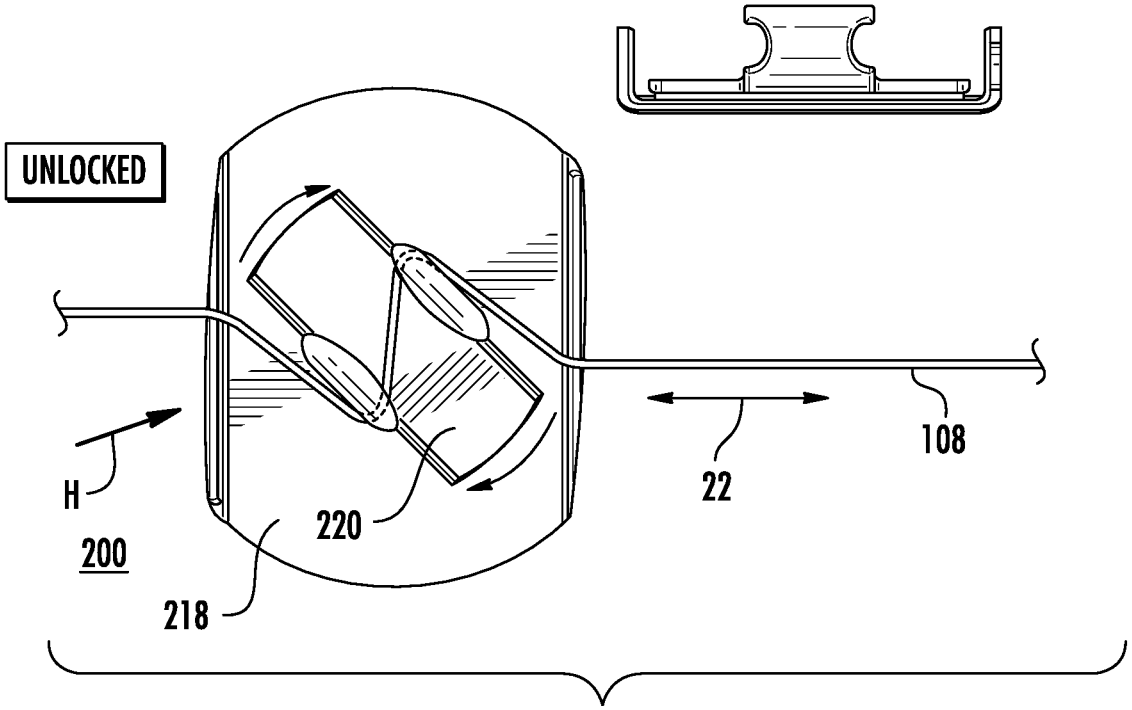
FIGS. 7A and 7B are plan views of the fusible mechanical linkage of FIG. 5, showing the spool of the fusible mechanical linkage in fixed and released positions.
Figure 7B:
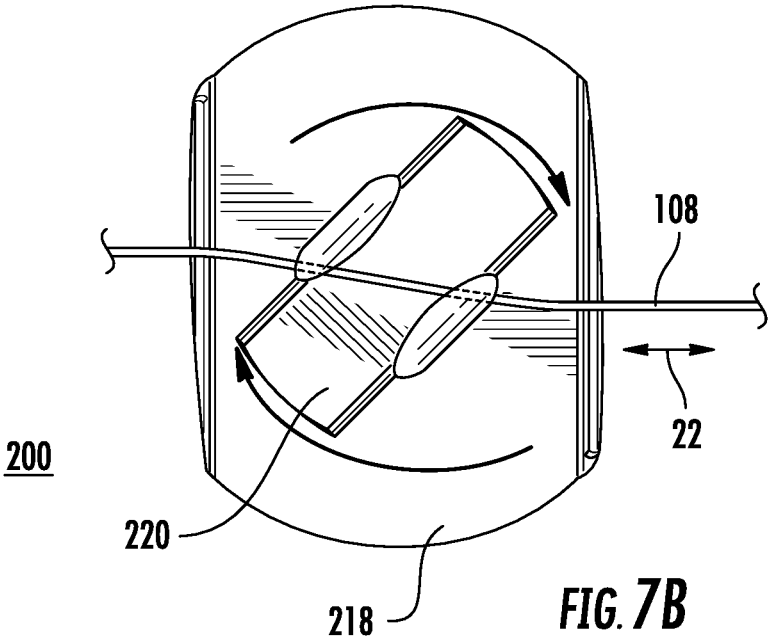

With reference to FIGS. 7A and 7B, fusible alloy 254 (shown in FIG. 5) softens upon application of heat H communicated by fire 16 (shown in FIG. 1), unlocking spool 220 from tensioner 218. Unlocking spool 220 from tensioner 218 allows tensile load 22 to rotate spool 220 relative to tensioner 218. Rotation R of spool 220 relative to tensioner 218 unloads tensile load 22 carried by actuation cable 108, causing valve 106 (shown in FIG. 1) to assume the open state, suppressant 18 (shown in FIG. 1) thereby issuing into protected space 10 (shown in FIG. 1). As with fusible mechanical linkage 100 (shown in FIG. 2), it is contemplated that fusible alloy 254 include a material such as solder or braze, each of which have melting points approximating that of a grease or cooking oil fire, tuning the responsiveness of fusible mechanical linkage 200 to the hazards which fire suppression system 102 (shown in FIG. 1) is arranged to mitigate.

Figure 8A:
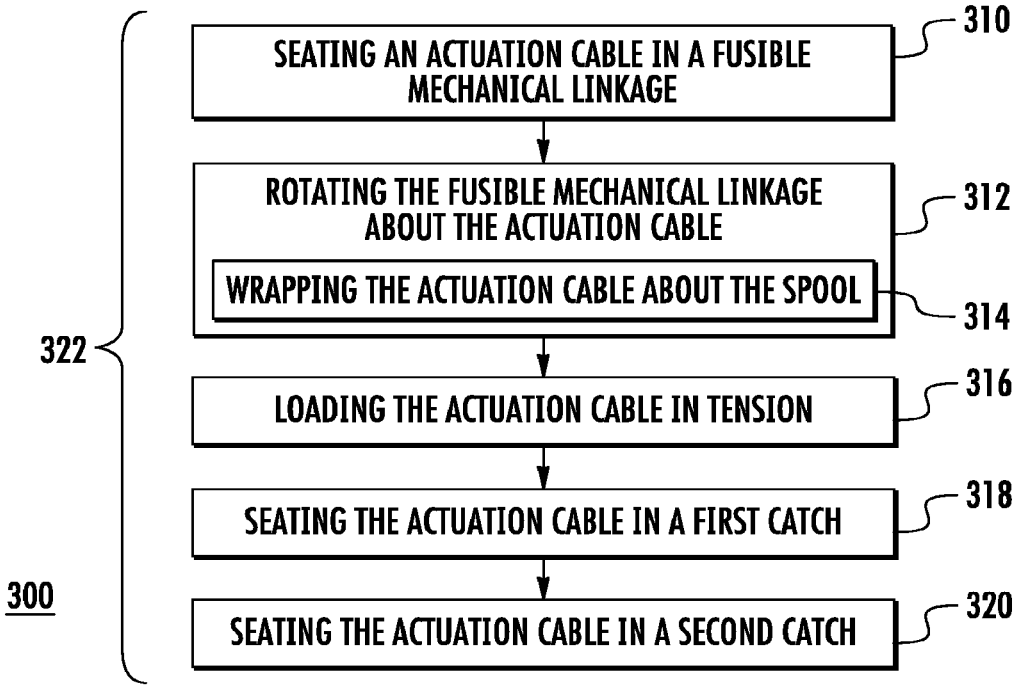
FIGS. 8A-8C are flow charts of methods for controlling tensile load within an actuation cable, showing operations for installing, removing, and reinstalling a fusible mechanical linkage.
Figure 8B:
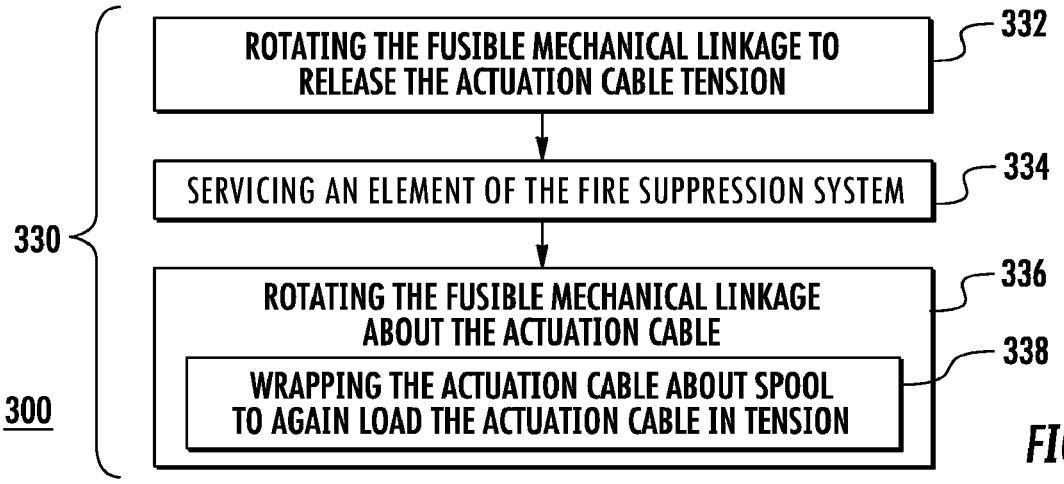
Figure 8C:
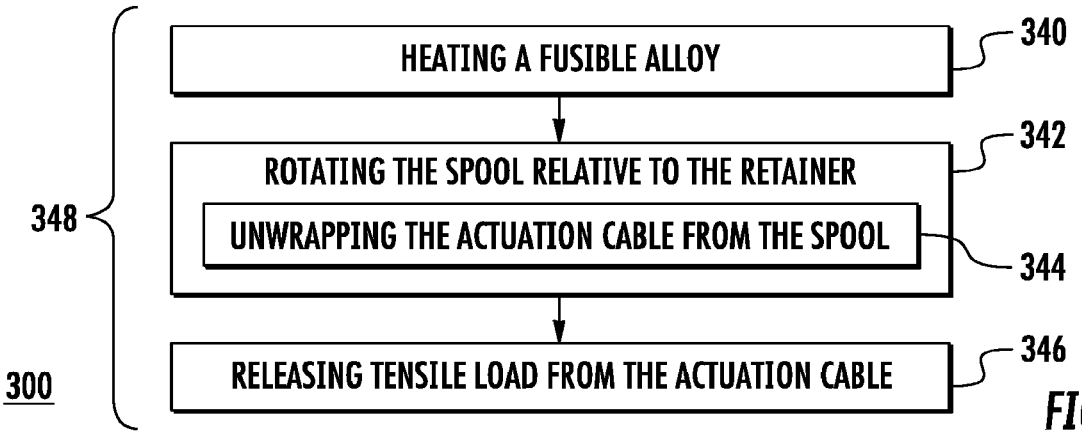

Referring to FIGS. 8A-8C, method 300 of adjusting a fire suppression system actuation cable, e.g., actuation cable 108 (shown in FIG. 1), is shown. Method 300 includes seating the actuation cable in a fusible mechanical linkage, e.g., fusible mechanical linkage 100 (shown in FIG. 1) or fusible mechanical linkage 200 (shown in FIG. 5), as shown by box 310. The fusible mechanical linkage 100/200 is rotated about the actuation cable, as shown by box 312, and the actuation cable wrapped about a spool of the fusible mechanical linkage 100/200, e.g., spool 120 (shown in FIG. 2) or spool 220 (shown in FIG. 5), as shown by box 314. As the actuation cable wraps about the spool the actuation cable loads in tension, e.g., by acquiring tensile load 22 (shown in FIG. 1), as shown by box 316. The fusible mechanical linkage 100/200 is then fixed relative to the actuation cable by seating the actuation cable in a first catch, e.g., first catch 122 (shown in FIG. 2) or first catch 222 (shown in FIG. 5), as shown with box 318, and seating the actuation cable in a second catch, e.g., second catch 124 (shown in FIG. 2) or second catch 224 (shown in FIG. 5), as shown by box 320. It is contemplated that operations 310-320 can be done in a one-twist and/or single-handed operation, as shown by bracket 322.

Referring to FIG. 8B, method 300 can include relieving tension and restoring tension with the fusible mechanical linkage 100/200, as shown with bracket 330. In this respect the actuation cable can be unseated from the first and second catches and rotated relative to the actuation cable, as shown with box 332, in a rotational direction opposite that of operation 312 (shown in FIG. 8A) relative to an axis of the spool. An element of a fire suppression system otherwise subject to the tensile load, e.g., fire suppression system 102 (shown in FIG. 1), can then be manipulated or serviced, as shown with box 334. Thereafter the fusible mechanical linkage 100/200 can then again be rotated relative to the actuation cable, as shown with box 336. As the fusible mechanical linkage 100/200 rotates relative to the actuation cable the actuation cable wraps about the spool, again loading the actuation cable in tension with the tensile load, as shown with box 338, and the actuation cable reseated in the first and second catches.

Referring to FIG. 8C, method 300 can include heating a fusible alloy, e.g., fusible alloy 154 (shown in FIG. 2) or fusible alloy 254 (shown in FIG. 5), as shown in box 340. The heating can soften the fusible alloy, unfixing the spool from a tensioner of the fusible mechanical linkage 100/200, e.g., tensioner 118 (shown in FIG. 2) or tensioner 218 (shown in FIG. 5), thereby allowing the actuation cable to rotate the spool relative to the tensioner, as shown by box 342. The rotation allows the cable to unwrap from the spool, as shown with box 344, thereby releasing tension in the actuation cable, as shown with box 346. It is contemplated that operations 340-346 can take place in a fire suppression system actuation event, as shown with bracket 348.

In embodiments described herein fusible mechanical linkages are employed to both tighten and hold tension in actuation cables. In certain embodiments, the fusible mechanical linkages tighten and hold tension in actuation cables with single twist-on motion. For example, in accordance with certain embodiments, a cable seat defined between knob portions and supported by a central column loosely receives the actuation cable. The fusible mechanical linkage is rotated, thereby rotating the central column and wrapping the actuation cable about at least a portion of the central column. The fusible mechanical linkage is then fixed, e.g., locked, to the actuation cable in the tightened state when rotation is such that the actuation cable seats in notched catches on opposite longitudinal ends of fusible mechanical linkage, the actuation cable having been guided over the catches during the rotational motion by ramps of the catches. Tension in the actuation cable is unloaded by the central column being released from the tensioner of the fusible mechanical linkage by heating (and softening) of a fusible alloy otherwise fixing the central column to the tensioner.

In accordance with certain embodiments, fusible mechanical linkages are described having a longitudinally extending plate member with cleats and laterally opposite fins. As the fusible mechanical linkage is rotated the plate member, and thereby the cleats, rotates such that the actuation cable wraps about the cleats, loading the actuation cable with a tensile load. The fusible mechanical linkage is then fixed, i.e., locked, to the actuation cable in the tightened state when rotation is such that the actuation cable seats in notches defined by the fins laterally opposite sides of fusible mechanical linkage, the actuation cable having been similarly guided over the fins during the rotational motion by ramps located on sides of the fins opposite the notches. Tension in the actuation cable is released by release of the plate member from the tensioner by heating (and softening) of a fusible alloy otherwise fixing the plate member and plate bodies to the tensioner.

As will be appreciated by those of skill in the art in view of the present disclosure, the capability to twist-on, in certain embodiments with a one-handed and/or singular motion, the fusible mechanical linkage can simplify the installation of the fusible mechanical linkage on the actuation cable. For example, in certain embodiments, tensile loading of the actuation cable can be accomplished with by single hand of a user, reducing time and eliminating the need to manage a separate linkage and take-up device. As will also be appreciated by those of skill in the art in view of the present disclosure, certain embodiments of fusible mechanical linkages described herein can simplify the adjustment and or reconfiguration of fire suppression systems, such as when a kitchen appliance layout is changed, by allowing use of a single, continuous actuation cable, and avoiding the need to cut the actuation cable into segments peculiar to a given kitchen appliance layout.

The methods and systems of the present disclosure, as described above and shown in the drawings, provide for fusible mechanical linkages, fire suppression systems, and methods of adjusting fire suppression system actuation cables with superior properties including simplified installation and adjustment. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A fusible mechanical linkage, comprising:

a tensioner having an aperture;

a spool with guides arranged on an end of the spool opposite a portion of the spool located within the aperture, the guides defining a cable seat therebetween; and a fusible alloy disposed between the spool and the tensioner, the fusible alloy fixing the spool to the tensioner below a predetermined temperature and allowing tension carried by an actuation cable extending through the cable seat to rotate the spool relative to the tensioner at temperatures above the predetermined temperature.

2. The fusible mechanical linkage as recited in claim 1, wherein the tensioner has a cleat arranged for palming in a one-handed twisting motion.

3. The fusible mechanical linkage as recited in claim 1, wherein the tensioner has a catch connected to the tensioner, the catch longitudinally offset from the aperture.

4. The fusible mechanical linkage as recited in claim 3, wherein the catch has a notch and a ramp arranged on laterally opposite sides of the catch.

5. The fusible mechanical linkage as recited in claim 3, wherein the catch has a column body connected on an end to the tensioner.

6. The fusible mechanical linkage as recited in claim 3, wherein the catch has a cleat.

7. The fusible mechanical linkage as recited in claim 3, wherein the catch is a first catch and further comprising a second catch connected to the tensioner on a side of the spool longitudinally opposite the first catch.

8. The fusible mechanical linkage as recited in claim 1, wherein the spool comprises a column, fixed to the tensioner by the fusible alloy, the spool guides defined by knob portions connected to the column and separated by the cable seat.

9. The fusible mechanical linkage as recited in claim 8, further comprising an actuation cable extending through the cable seat and between the knob portions, the actuation cable wrapping about exterior surface portions of the column.

10. The fusible mechanical linkage as recited in claim 1, wherein the spool comprises a plate member, fixed to the tensioner by the fusible alloy, the spool guides defined by cleats connected to the tensioner by the plate member.

11. The fusible mechanical linkage as recited in claim 10, further comprising an actuation cable extending through the cable seat and between the cleats, the actuation cable wrapping about exterior surface portions of the cleats.

12. The fusible mechanical linkage as recited in claim 1, wherein the fusible alloy comprises a metallic material having a melting point that is about the same as a fire fueled by cooking oil or grease.

13. The fusible mechanical linkage as recited in claim 1, wherein the fusible alloy comprises solder or braze.

14. A fire suppression system, comprising:

a fusible mechanical linkage as recited in claim 1;

an actuation cable extending through the cable seat; and a valve operably connected to the actuation cable and arranged to issue suppressant into a protected space, wherein the tensioner has first and second catches having notches and connected to the tensioner, the first catch longitudinally offset from the aperture, the second catch connected to the tensioner on a side of the spool longitudinally opposite the first catch, wherein the actuation cable extends through the notches of the first and second catches.

15. The fire suppression system as recited in claim 14, wherein the spool comprises a column connected to the tensioner by the fusible alloy and guides defined by knob portions connected to the tensioner by the column, the actuation cable wrapping about exterior surface portions of the column.

16. The fire suppression system as recited in claim 14, wherein the spool comprises a plate member connected to the tensioner by the fusible alloy and guides defined by cleats connected to the tensioner by the plate member, the actuation cable wrapping about exterior surface portions of the cleats.

17. A method of adjusting a fire suppression system actuation cable, comprising:

seating an actuation cable in a fusible mechanical linkage comprising a tensioner having an aperture, a spool with guides arranged on an end of the spool opposite a portion of the spool located within the aperture, the guides defining a cable seat therebetween, and fusible alloy arranged between the spool and the tensioner; and rotating the fusible mechanical linkage about the actuation cable, the actuation cable wrapping about spool to load the actuation cable in tension.

18. The method as recited in claim 17, further comprising seating the actuation cable in first and second catches, the first catch connected to the tensioner and longitudinally offset from the aperture, the second catch connected to the tensioner on a side of the spool longitudinally opposite the first catch.

19. The method as recited in claim 17, further comprising:

heating the fusible alloy; and rotating the spool relative to the tensioner, the actuation cable unwrapping from the spool to release tension from the actuation cable.

20. The method as recited in claim 17, further comprising:

rotating the fusible mechanical linkage to release the actuation cable tension;

servicing an element of the fire suppression system; and rotating the fusible mechanical linkage about the actuation cable, the actuation cable wrapping about spool to again load the actuation cable in tension.

* * * * *